United States Patent [19]

Johnson et al.

[11] Patent Number: 4,979,625

[45] Date of Patent: Dec. 25, 1990

[54] KEY KEEPER

[76] Inventors: Merlyn B. Johnson, 2904 Joan La., Billings, Mont. 59102; Brycelyn B. Johnson, 12601 St. Andrews Dr., Oklahoma City, Okla. 73120

[21] Appl. No.: 509,362

[22] Filed: Apr. 16, 1990

[51] Int. Cl.[5] ..... A47F 5/00

[52] U.S. Cl. ..... 211/13; 211/DIG. 1; 248/206.5; 312/245

[58] Field of Search ..... 211/13, DIG. 1, 87; 248/206.5; 312/245

[56] References Cited

U.S. PATENT DOCUMENTS

| | | | |
|---|---|---|---|
| 982,940 | 1/1911 | DeSilva | 211/DIG. 1 X |
| 1,624,741 | 4/1927 | Leppke et al. | 211/DIG. 1 X |
| 2,954,874 | 10/1960 | Rouse | 248/206.5 X |
| 3,497,074 | 2/1970 | Shaheen | 211/13 |
| 4,209,212 | 6/1980 | McGoldrick | 312/245 |
| 4,413,736 | 11/1983 | Nibling | 312/245 X |

*Primary Examiner*—Robert W. Gibson, Jr.

[57] ABSTRACT

A key keeper for use with keys comprising two wooden frames. Hinges pivotally connect the two frames such that the front frame is overlying the back frame. The front frame defining a picture frame and including matting enclosing its backside, the front frame containing clear glass and matted picture, the backside of the front frame further including a metal tab attached thereto. The back frame having a means for attaching to a wall and being completely enclosed on its backside with a piece of sheet metal backing. The back frame including a round magnet disposed in an inset in a front surface which is aligned with the metal tab on the backside of the front frame. The magnet will magnetically engage the metal tab thereby holding the two frames together in a closed position. A magnetic holding device comprising a strip of metal and a strip of magnetic tape attached to the backside of the metal strip. The bottom portion of the front side of the metal strip having a hook allowing a ring of keys or the hole of a single key to be placed thereon. The hook being compressible combining the holding device and ring of keys or key into a single unit. The top portion of the metal strip above the hook having ample surface capable of receiving written notation. The magnetic side of the holding device lies against the sheet metal backing and maintains its position by magnetic adhesion.

1 Claim, 3 Drawing Sheets

KEY KEEPER

This invention relates to a novel assembly of two wooden frames constructed and connected together in a manner that conceals various keys between two said frames. A novel magnetic device is used to secure or retain the keys in position in the space between the two frames. A strip of metal and magnetic tape comprise the device.

Key owners often have keys lying in a drawer or cabinet that allows easy accessibility by children or others. This invention, attached to a wall, conceals the keys and keeps the keys out of reach of small children.

Some key owners place their keys on exposed hooks of a key rack. Such action promotes easy accessibility by intruders. This invention when attached to a wall simply appears to be a wall hung picture adding decor to a room. Intruders will not readily know that keys are concealed behind the picture frame. Also, writing the specific use of a key on a key rack rather than the key itself also creates a problem if the removed key is not replaced to its particular location identified on the rack. Additionally, a means of identifying the specific use of a key can be a problem. For example, identifying the utility of a key by writing on a small paper disc or piece of tape and attaching same to a key can be cumbersome. Also, identifying the utility of a key in such a manner creates a problem if the written notations are not clearly visible when the key is returned to the rack. This invention creates a simple means of identifying the utility of a key by providing a write-on surface on the top portion of the front side of the metal piece of the magnetic device. With the utility of the key visible on the front side of the metal piece, removing and replacing the magnetic device to a particular location is of no concern. The magnetic device only can be placed within the Key Keeper in a definite manner always assuring visible exposure of the written utility of the attached key.

Other benefits and advantages of the invention will be apparent from the following descriptions and accompanying drawings in which.

Figure 1:
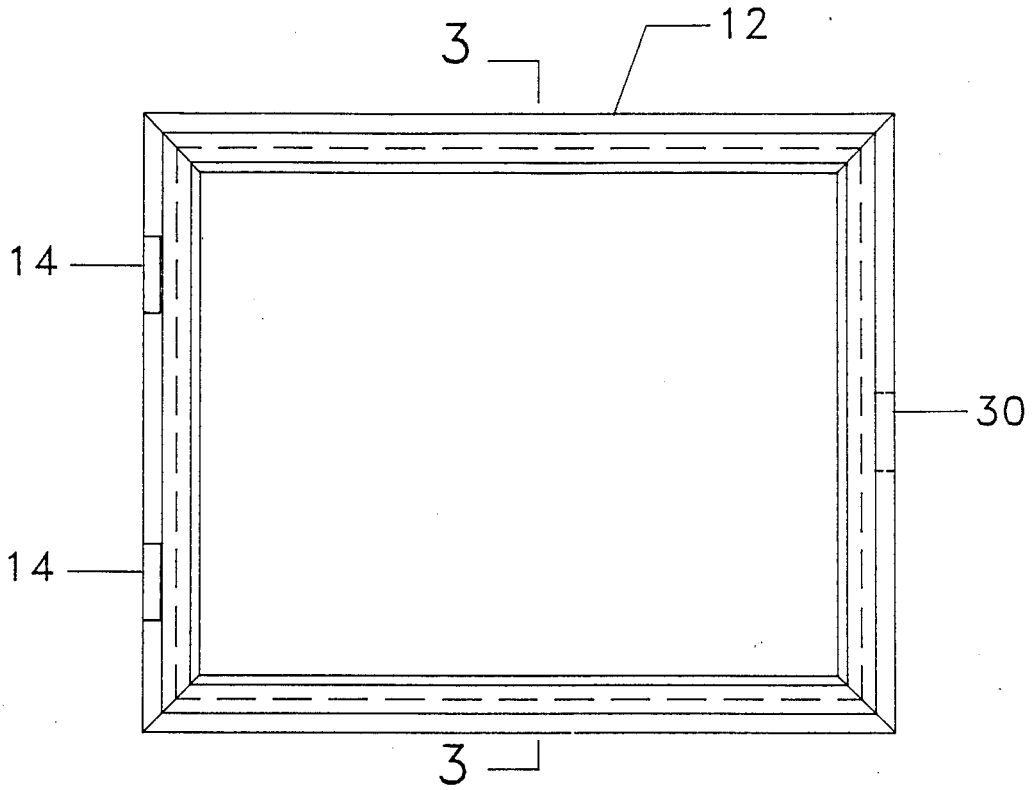
FIG. 1 is a front elevation of the front frame of the invention.
Figure 2:
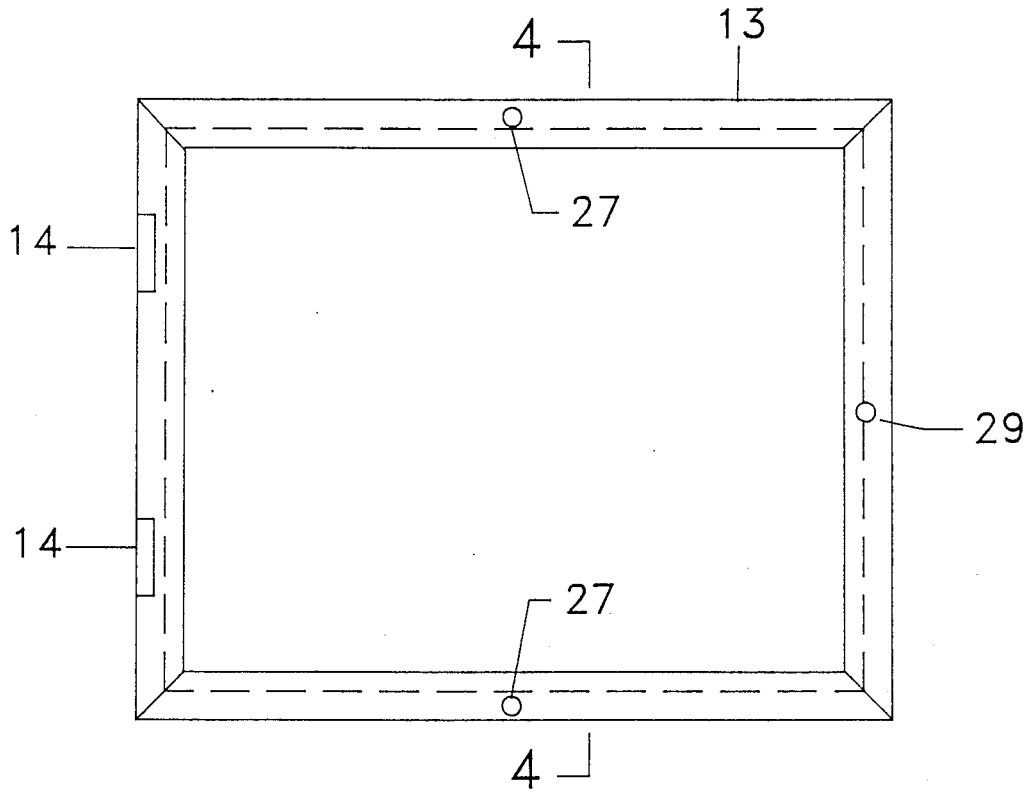
FIG. 2 is a front elevation of the back frame.
Figure 3:
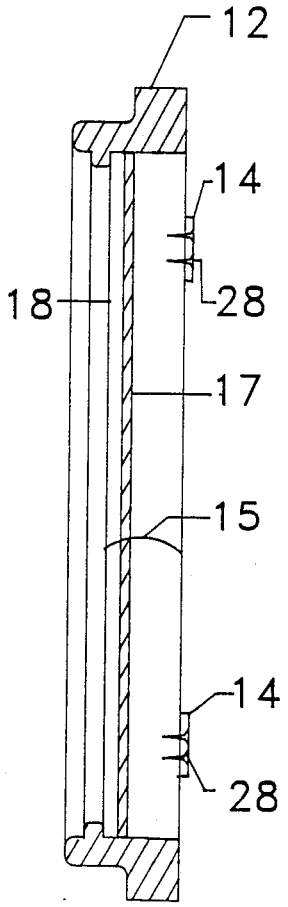
FIG. 3 is a sectional view taken along line 3—3 of FIG. 1.
Figure 4:
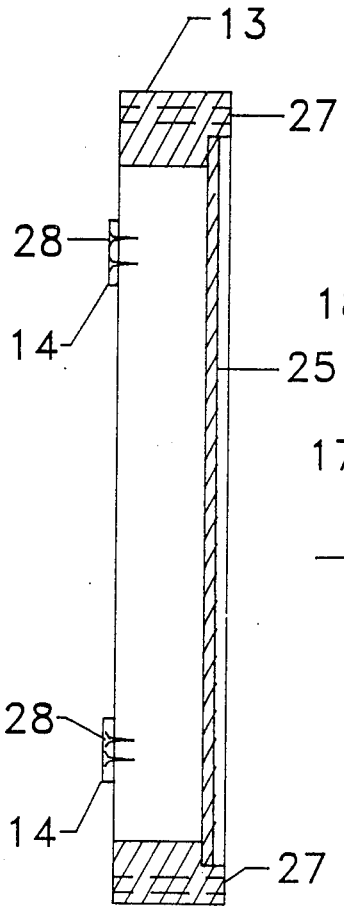
FIG. 4 is a sectional view taken along line 4—4 of FIG. 2.
Figure 5:
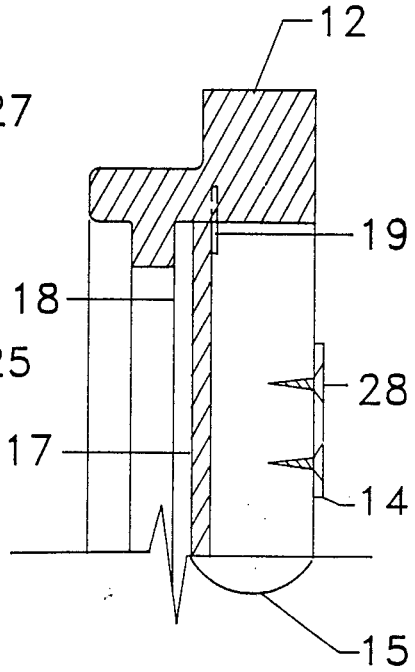
FIG. 5 is a side view of the upper portion of FIG. 3.
Figure 6:
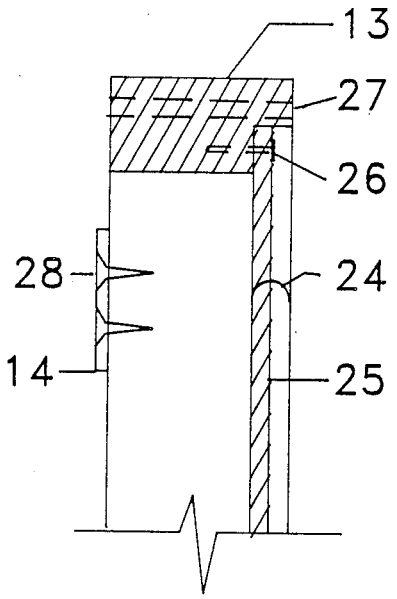
FIG. 6 is a side view of the upper portion of FIG. 4.

As shown in the drawings, two wooden picture like frames 12 and 13 are constructed of similar size. Two brass hinges 14 pivotally connect the two frames together comprising a single unit. Certain light nonferrous metals or plastic resins could be used in constructing the frames other than wood.

The front frame 12 is constructed of conventional wooden picture frame molding that is readily available on the open market. The frame molding requires a rabbet 15. A pane of glass 18 is placed within the borders of rabbet 15. In addition, a picture print and matt board 17 are placed behind the glass 18. The matt board is positioned with finished side exposed and secured with wire staples 19. The staples can be bent for easy removal of matt, picture print and glass.

The back frame 13 is custom molded or shaped. A rabbet 24 is cut in the backside of the frame parts. A piece of sheet metal backing 25 is cut to fit within the borders of the rabbeted area of the assembled frame. The metal is secured firmly with nails 26. Two holes 27 are drilled through the upper and lower frame parts of the back frame. The holes are positioned in the center of the parts equal distance from their respective ends. Two wood screws are inserted through the holes to attach the novel invention to a wall.

The two frames are pivotally connected together using two brass hinges 14. Screws 28 are used to attach the hinges to the front and back frames. The hinges are attached to the corresponding side part of each frame. One hinge portion is positioned on the front surface of the back frame, the other portion on the backside surface of the front frame.

A round ceramic magnet with two flat surfaces 29 is positioned in the front surface of the side part of the back frame. A shallow hole is drilled in the front surface of a side part. The magnet is inset in the hole using glue to secure it in place.

A metal tab 30 is positioned on the back surface of the side part of the front frame. The tab is glued to the back surface of the front frame in a position directly opposite the magnet of the back frame. When the front and back frames are closed, the magnet and metal tab meet, causing a magnetic force that holds the frames in a closed position.

Figure 7:
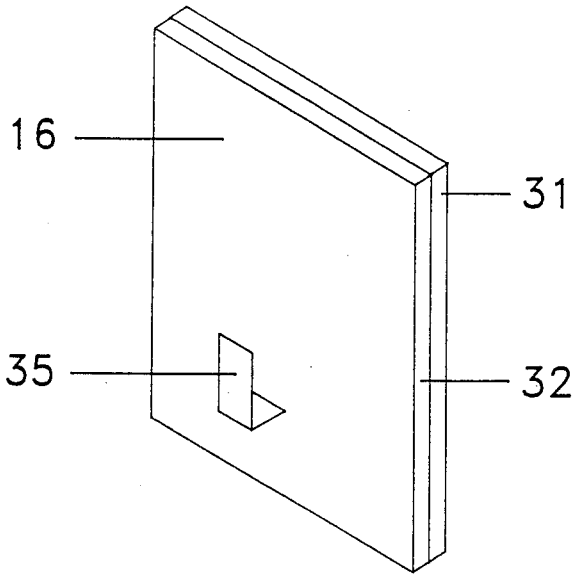
FIG. 7 is a perspective view of the assembled magnetic device.
Figure 8:
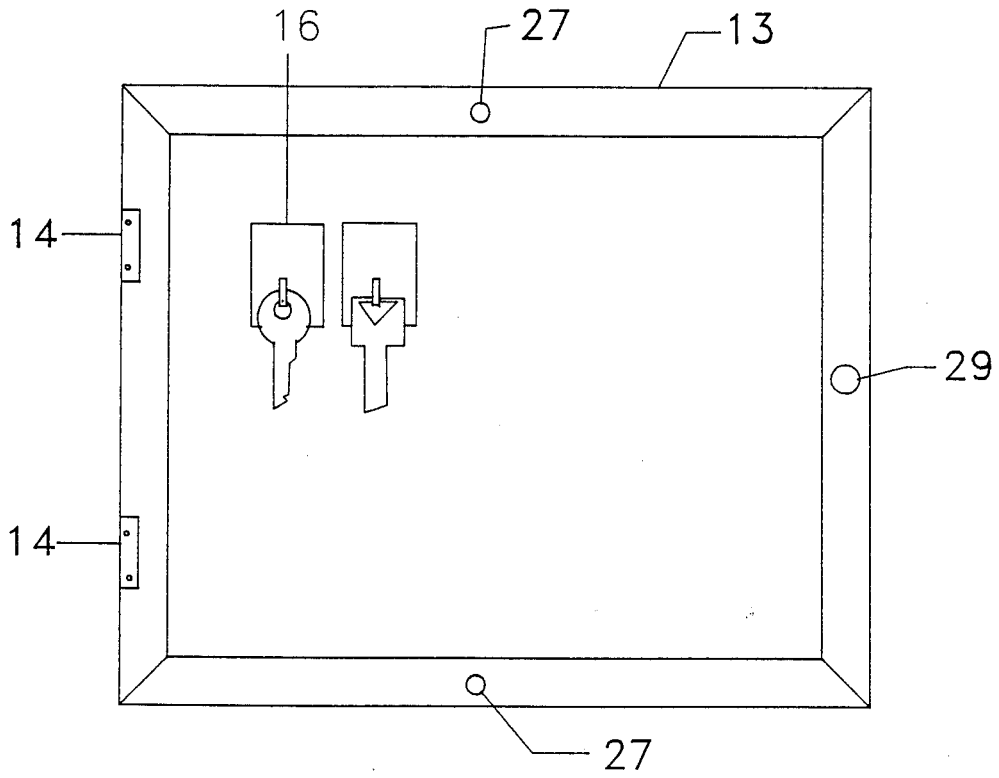
FIG. 8 is a front view of two magnetic devices (with keys) magnetically attached to the metal backing of the back frame.

A magnetic device FIG. 7 is used to secure a key and retain it in a position. The device includes a magnetic tape 31 and metal piece 32. A hook 35 is attached at the bottom edge of the front side of the metal piece. The hook is used for attaching a single key or a ring of keys to the metal piece. The attached key may be secured firmly to the metal piece by compressing the top portion of the hook towards the front side of the metal piece. The magnetic tape is glued to the backside of the metal piece. The edges of the magnetic tape and metal piece are positioned evenly with one another. The top portion of the metal piece provides ample space 16 for writing notations identifying the utility of the attached key.

With the frames in a closed position, ample space is provided between the frames for housing multiple magnetic devices with attached keys. The space is bordered by the interior borders of all frame parts of the front and back frames and the backside surface of the picture matting of the front frame and anterior surface of the sheet metal backing of the back frame. The magnetic device attaches to the sheet metal backing by magnetic adhesion but can be easily and quickly removed and replaced by hand.

What is claimed is:

1. A key keeper including a front frame and a back frame, two hinges pivotally connecting the two frames such that the front frame is overlying the back frame, the keeper further defined by:

(a) the front frame defining a picture frame and including picture matting enclosing its backside, the backside of the front frame further including a metal tab attached thereto;

(b) the back frame having a means for attaching to a wall and being completely enclosed on its backside with a sheet metal backing, the back frame further including a round magnet disposed in an inset in a front surface thereof which is aligned with the metal tab on the backside of the front frame such that the magnet will magnetically engage the metal tab thereby holding the two frames together in a closed position;

(c) a magnetic holding device comprising a strip of magnetic tape and a strip of metal: the front surface of the holding device with a hook for attaching a single key or a ring of keys and a write-on surface above the hook for identifying the utility of the key(s).

* * * * *